United States Patent [19]

Berg

[11] 4,234,292

[45] Nov. 18, 1980

[54] FUEL INJECTION PUMP, ESPECIALLY FOR INTERNAL COMBUSTION ENGINES

[75] Inventor: Josef Berg, Cologne, Fed. Rep. of Germany

[73] Assignee: Klöckner-Humboldt-Deutz Aktiengesellschaft, Cologne, Fed. Rep. of Germany

[21] Appl. No.: 910,578

[22] Filed: May 30, 1978

[30] Foreign Application Priority Data

May 27, 1977 [DE] Fed. Rep. of Germany ..... 2723969

[51] Int. Cl.[3] ..... F04D 49/02; F02M 59/10

[52] U.S. Cl. ..... 417/214; 417/218; 417/490; 123/457

[58] Field of Search ..... 417/212, 214, 218, 499, 417/494, 490; 123/139 R, 139 AA, 139 AP

[56] References Cited

U.S. PATENT DOCUMENTS

| | | | |
|---|---|---|---|
| 1,901,835 | 3/1933 | Thomas | 123/139 AD |
| 1,953,449 | 4/1934 | Thege et al. | 123/139 AA |
| 2,378,998 | 6/1945 | Garancher | 417/214 |
| 2,407,343 | 9/1946 | Pyne et al. | 417/214 |
| 2,414,617 | 1/1947 | Summers | 417/218 X |

FOREIGN PATENT DOCUMENTS

| | | | |
|---|---|---|---|
| 115791 | 2/1946 | Sweden | 123/139 R |

*Primary Examiner*—Leonard E. Smith
*Attorney, Agent, or Firm*—Becker & Becker, Inc.

[57] ABSTRACT

A fuel injection pump, especially for internal combustion engines, which includes a pump piston axially displaceable in a cylinder of a pump housing and operable by a cam of a camshaft through the intervention of a rocker. For controlling the quantity of the fuel to be injected, the circumference of the piston is provided with an oblique control groove for cooperation with a control bore in the cylinder. The rocker is pivotally connected to the pump piston and in spaced relationship to the piston is under the load of a spring determining the maximum injection pressure. Between the area where the spring acts upon the rocker and where the rocker is pivotally connected to the pump piston, the rocker is provided with a roller adapted to roll on the cam while the spring presses the rocker in fuel feeding direction against an abutment.

13 Claims, 2 Drawing Figures

FUEL INJECTION PUMP, ESPECIALLY FOR INTERNAL COMBUSTION ENGINES

The present invention relates to a fuel injection pump for internal combustion engines with a piston operable by a cam of a cam shaft through the intervention of a rocker and axially displaceable in a cylinder of a pump housing. More specifically, the invention relates to a fuel injection pump of the above mentioned type in which the piston is rotatable for controlling the quantity of the injected fuel and which at its circumference is provided with an oblique control groove which cooperates with a control bore in the cylinder while the rocker is pivotally connected to the pump piston and in spaced relationship thereto is under the load of a spring.

Recent research carried out in connection with efforts to reduce the exhaust gas emission and the fuel consumption has, among others, resulted in an increase of the injection pressure. The term "high pressure injection" today is intended to mean the introduction of the fuel into the combustion chamber at peak injection pressures of about 800 bar; in connection with basic research, however, pressures of more than 2000 bar are aimed at. Such high injection pressure, however, cause difficulties with regard to the ability of the fuel injection devices to withstand such pressures, and also with respect to the ability of controlling the fuel injection over a wide control range as it is customary with motor vehicles. The optimization with regard to the fuel consumption, the exhaust gas quality, and the noise development makes it necessary that the injection pressure, the injection period, and the injection point, etc., can be varied.

With presently customary fuel injection pumps as disclosed for instance in German Auslegeschrift No. 2,303,824, the pump piston is by the cam of a cam shaft through the intervention of a pushrod pressed outwardly so that the fuel is injected into the combustion chamber through the intervention of an injection valve. A return spring returns the pump piston after the fuel injection on the trailing cam flank into its starting position. Inasmuch as the injection is effected at a time when the pushrod is located within the region of the supporting cam flank and is completed prior to the pushrod reaching the crest of the cam, it is possible with relatively small dimensions to obtain a high injection pressure without exceeding the permissible pressure per unit of area on the cam path. However, it should be borne in mind that with this type of pump, the injection pressure can be laid out optimally only for one point of operation and changes with increasing speed of rotation and load in conformity with the hydrodynamic conditions of the injection system. This means that within the low speed range and at low load, the injection pressure must, in view of its tendency to increase, be lower than is desirable for an optimum combustion. This fact becomes noticeable particularly with internal combustion engines having a wide operational range as is, for instance, the case with motors for vehicles.

German patent application No. M 85 29/46C$^2$ describes a fuel injection pump of the above mentioned type, according to which the cam of the cam shaft returns the pump piston to its starting position through the intervention of a rocker and simultaneously therewith loads a spring which in turn loads the rocker and brings about the delivery stroke of the pump piston. This will assure that the maximum injection pressure is limited by the spring force. The spring characteristic and the spring preload can be adapted to the respective conditions of operation. To make sure that an injection pressure will be obtained which corresponds to the maximum spring load, the rocker must, during the injection operation, be lifted off the cam path so that the spring forces, the pressure forces and the mass forces acting upon the rocker will be in an equilibrium. This requires that the cam must be provided with a very steeply dropping flank directly after its highest elevation.

To maintain the injection point necessary for the Diesel engine operation is possible only by means of a sharp-edged merging area from the highest elevation to the descending flank of the cam. The sharp-edged bend or deflection is under the load of the maximum force. In this connection, at higher injection pressures, pressures per unit of area occur which cannot be mastered or controlled by any presently known material. In addition thereto, it is to be noted that after the pump piston has been relieved of the fuel pressure at the end of the injection operation, the rocker will hit the cam path at full spring force and will destroy the cam path.

It is therefore an object of the present invention, while taking advantage of maximum injection pressures, to provide a fuel injection pump which will operate satisfactorily at low speeds and under low load, and which with regard to the structural elements and the overall size will have a long service life and will permit an optimum adaptation to different conditions of operation.

This object and other objects and advantages of the invention will appear more clearly from the following specification in connection with the accompanying drawings, in which.

Figure 1:
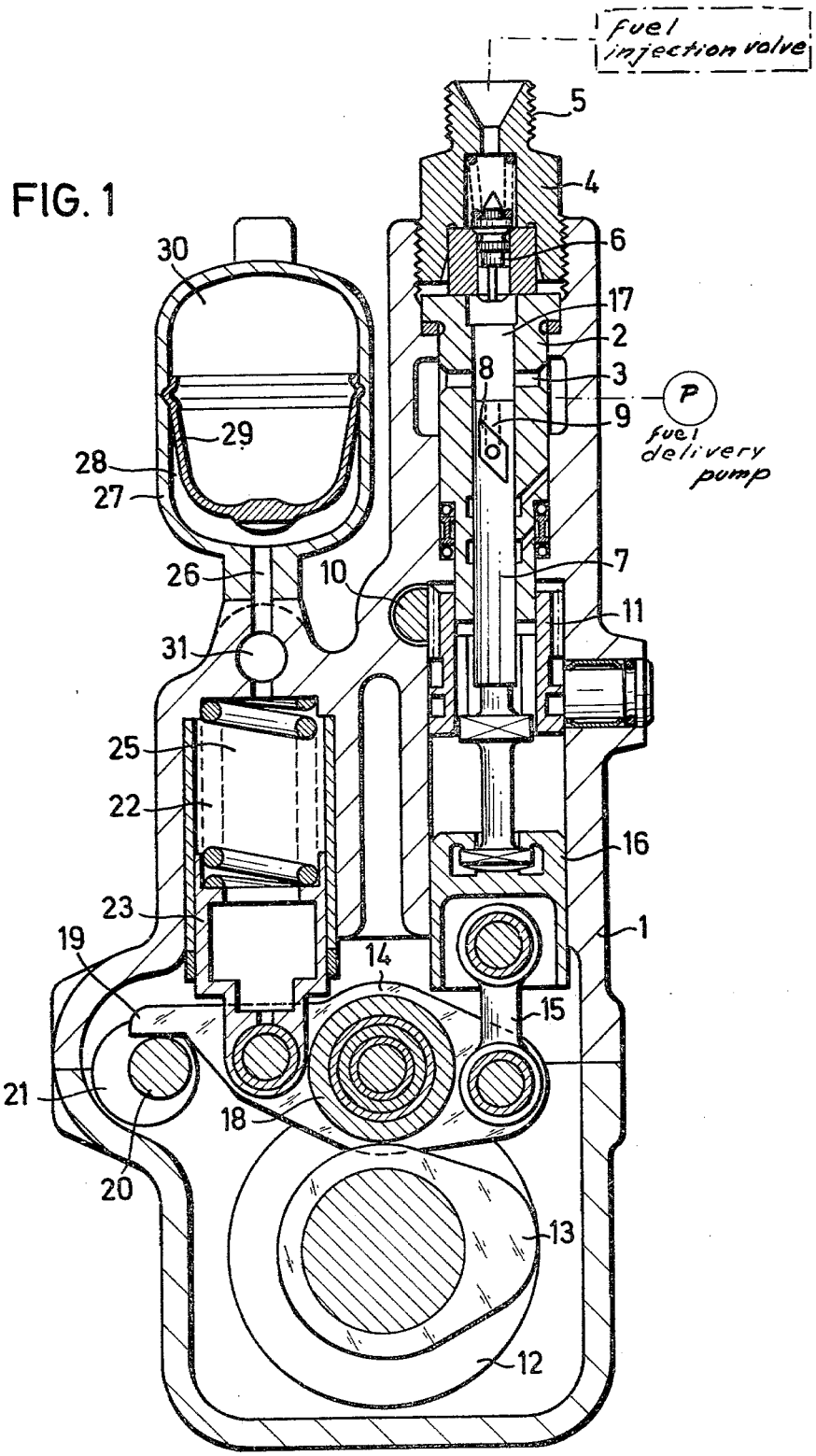
FIG. 1 represents a cross section through a fuel injection pump according to the invention with an abutment for the rocker, the abutment being fixed to the pump housing.

The fuel injection pump according to the present invention is characterized primarily in that the rocker, between the point of attack of the spring and the linkage area of the pump piston, moves by means of a roller on the cam, and the spring presses the rocker in delivery direction against an abutment.

With the fuel injection pump according to the invention, the cam of the cam shaft actuates the pump piston through the intervention of a rocker. As long as the injection pressure does not exceed the value predetermined by the spring and the dimensions of the rocker, and thus the rocker engages the abutment, the fuel injection pump operates substantially in the manner of a fuel injection pump of the customary type. However, when the fuel injection pressure exceeds the predetermined value, the piston stops upward movement into the pumping chamber and the rocker is lifted off from the abutment if the cam continues to rise maximum injection pressure is limited solely by the spring force until the control groove of the piston intersects the control bore of the cylinder. After the pump piston has been relieved of the pressure, the rocker is by means of the pressure spring returned to its starting position whereas the pump piston is returned by means of the return spring of customary type. During the entire injection operation, the roller engages the cam path and subjects the same only in the region of its supporting flank to the maximum load, whereas within the region of the cam crest, the forces are greatly decreased in view of the pressure relief and the counteracting mass forces.

According to a further development of the invention, it is suggested that the abutment forms a support, which is fixedly connected to the housing, on which one end of the oscillating lever is pivotally supported. Furthermore it is suggested that the point of attack of the spring is located between the support and the roller. Such an arrangement makes it possible to do without a return spring. The pressure spring itself serves as return spring and with regard to the support exerts a returning moment upon the rocker.

According to a still further development of the invention, the abutment may be formed by an angle lever which is rotatably journalled on the pivot axis of the rocker and in the housing. As a result thereof, a precise guiding of the roller will be obtained regardless of the guiding of the rocker by the pushrod or the link connection of the spring.

For adjusting the idling stroke and in connection therewith for setting the basic position of the start of the delivery, the abutment can expediently be made variably adjustable.

Fundamentally, a mechanical spring can be employed the spring characteristic of which can be adapted to the respective requirements of operation by the design, the change in the effective length, and by the combination of a plurality of springs, while the desired injection pressure is adjustable by a corresponding preloading of the spring. For obtaining a better control of the injection pressure, it is, however, advantageous that, according to a further development of the invention, the spring is designed as hydraulic or pneumatic spring or as a combination of a mechanical spring with a pneumatic or hydraulic spring. The characteristic of the spring is in this connection optimally to be adapted to the respective conditions of operation by the employment of throttles and controlled pressure changes in the spring through the intervention of corresponding control members. In this connection, the springs will within the full load range be subjected to a preload which corresponds approximately to the admissible injection pressure.

According to a still further development of the invention it is suggested that the spring force and/or the spring characteristic are variable in conformity with the respective parameters of operation of the internal combustion engine as, for instance, speed, load, exhaust gas temperature, harmful emission values, etc. Such a variability can easily be realized by known control means which influence the pressure of the pneumatic or hydraulic spring.

For laying out the spring forces, the spring volume, and the pressure per unit of area in an optimum manner, it is expedient according to a further development of the invention that the spring and the pump piston engage the rocker by means of non-uniform lever arms with regard to the pivot axis. In this way a particularly advantageous coordination of forces and overall structural volume can be obtained with regard to the control behavior.

Referring now to the drawings in detail, the fuel injection pump comprises in customary manner a pump housing 1 having inserted thereinto a cylinder bushing 2 with control passages 3. The cylinder bushing 2 is held in its position by a pressure exerting thread connection 4 which has a connection 5 for a non-illustrated pressure conduit leading to a fuel injection valve. In the thread connection 4 there is provided a pressure valve 6. A pump piston 7 is axially displaceably arranged in the cylinder bushing 2. The circumference of the piston 7 is provided with an oblique control groove 8 which through a passage 9 communicates with a pump pressure chamber 17 and cooperates with the control passages 3. The pump piston 7 is furthermore rotatable by a rack 10 through the intervention of an adjusting device 11.

The pump piston 7 is driven by a cam shaft 12 with a cam 13 through a rocker 14 which latter has a pushrod 16 linked thereto through the intervention of a connecting rod 15. The pushrod 16 is positively connected to one end of the pump piston 7. On the rocker 14 there is mounted a roller 18 which is adapted to roll on the cam 13. The free end 19 of the rocker 14 is pivotally resting on a stop 20 fixedly connected to the housing. The stop 20 is adjustable by means of an eccentric 21. Between the stop 20 and the roller 18, a spring 22 engages the rocker 14 through the intervention of a guiding piston 23.

The guiding piston 23 is mounted in a cylinder 25 which simultaneously forms the spring chamber for the spring 22 and through a connecting passage 26 is connected to a hydropneumatic pressure spring 27. The pressure spring 27 comprises a container the hydraulic part 28 of which is by means of a cap diaphragm 29 separated from the pneumatic chamber 30. In the connecting passage 26 there is arranged a variable throttle 31 which is unilaterally effective during the fuel delivery.

Figure 2:
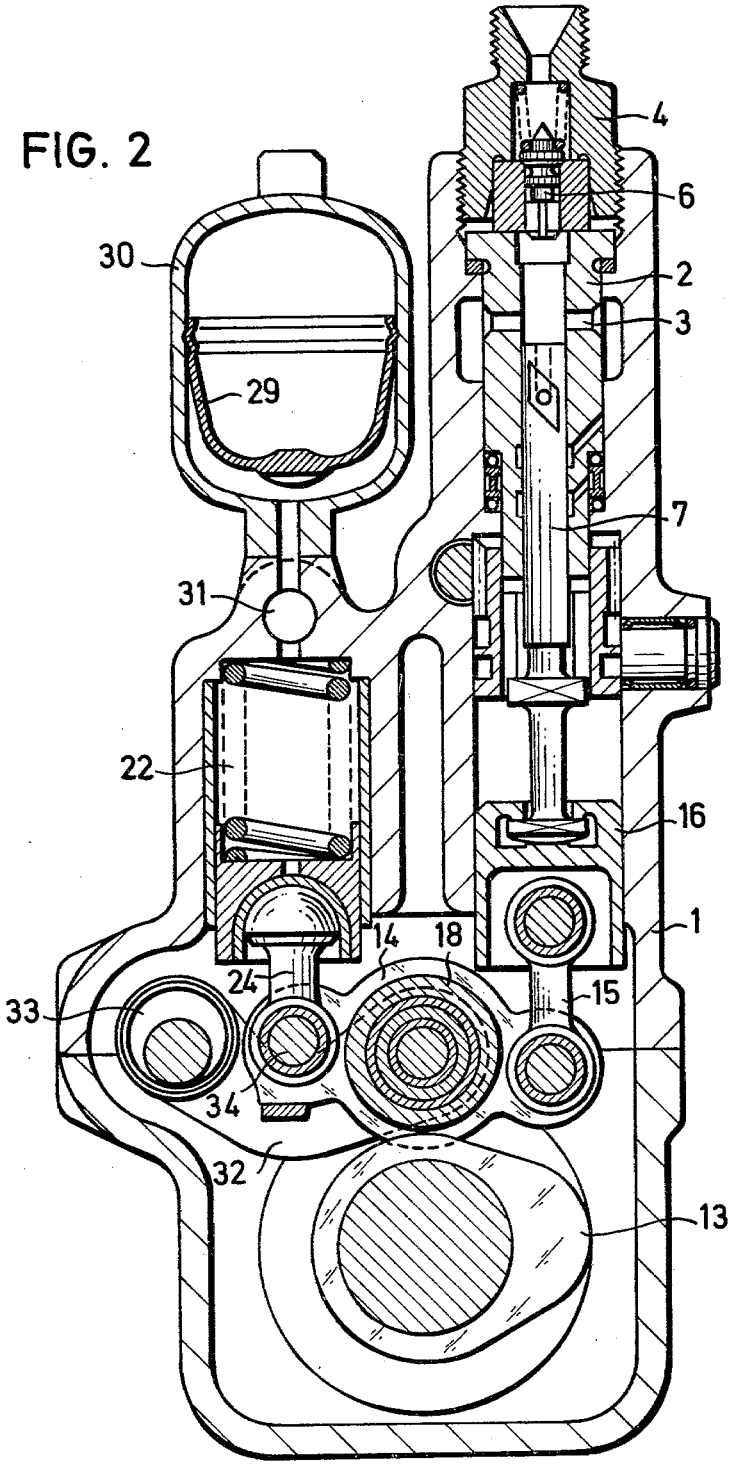
FIG. 2 represents a cross section through a fuel injection pump according to the invention which an abutment formed by an angle lever which is journalled on the pivot axis of a rocker and in the housing of the pump.

Referring now to FIG. 2, those parts having the same function as in the arrangement of FIG. 1 have been designated with the same reference numerals as in FIG. 1. The design according to FIG. 2 differs from that of FIG. 1 in that instead of the stop 20 being fixedly connected to the housing, an angle lever 32 is pivotally arranged in the housing. The free end of the angle lever 32 rests on the axle of the roller 18. The mounting area of the angle lever 32 in the housing 1 is designated with the reference numeral 33 and can be adjusted by means of an eccentric. The angle lever 32 serves as abutment for the rocker 14 inasmuch as a transverse pin 34, which simultaneously serves for effecting a linkage connection of the linkage rod 24 of the guiding piston, is adapted to engage the throat of the angle lever 32.

OPERATION

The fuel is delivered by a non-illustrated fuel feeding pump through control passsages 3 into the pump pressure chamber 17 of the fuel injection pump. During the stroke of the pump piston 7, the control passages or openings 3 of the pump piston 7 are periodically covered up by the pump piston 7. At this time the fuel delivery starts via pressure valve 6 into the pressure line and the pressure build-up begins. When a predetermined pressure has been reached, the non-illustrated fuel injection valve opens. The fuel injection is terminated when the pump piston 7 with its control groove 9 moves over the control passages 3. At this time, the pressure in the pressure chamber 17 drops and the pressure valve 6 closes. By a turning movement of the pump piston 7 by means of the rack 10 and by means of the adjusting device 11, the injection period and thus the quantity of injected fuel can be varied. The stroke movement is brought about by the cam 13 of the cam shaft 12 and, more specifically, by the cam 13 lifting the roller 18 and the rocker 14 connected thereto. The roller 18 is urged by means of a spring 22 continuously against the cam 13. In this connection, the end 19 rests on the stop 20 as long as the moment exerted by the injection pressure upon the rocker 14 does not exceed the moment exerted by the spring 22. Within this working range, the fuel injection pump operates in the same manner as heretofore known and well proved fuel injection pumps. However, when the moment exerted by the injection pressure upon the rocker 14 exceeds the moment exerted by the spring 22 since the piston 7 ceases upward movement into the pumping chamber 17 the end 19 of the rocker 14 is lifted off the stop 20. The maximum injection pressure is limited, independently of the dynamic forces in the injection system, only in conformity with the spring characteristic of the springs 22 and 27. In view of the changes of the spring characteristics and the preload of the springs, the magnitude of the injection pressure and also the course of the pressure can in wide ranges be adapted to the requirement for an optimum operation of the internal combustion engine. The change in the spring characteristic can particularly easily be varied and controlled by the employment of hydropneumatic springs. Thus, by providing throttles and other control members, any desired spring characteristic can be obtained in conformity with the parameter of operation to be influenced.

To obtain an optimum delivery speed and a rise in pressure which is as high as possible for the starting value, which can be controlled by the measures according to the invention, the realization of great cam heights and of a lever transmission is advantageous by means of which long idling strokes and high delivery speeds can be achieved. A simple adjustment of the idling stroke can be effected by adjusting the stop 20 by means of an eccentric (for instance with regard to FIG. 2) by displacing the journalling point 33 of the angle lever 32.

The layout of the fuel injection pump should be such that at the nominal speed and full load the required quantity of fuel will be injected at the maximum admissible injection pressure within the available time, and that the injection speed with small delivery quantities and at low speed will still be high enough that approximately the maximum injection pressure can be obtained.

In summary there can be stated that the pump piston 7 can only be pushed or shifted still further upwardly when the spring pressure is higher than the pressure in the chamber 17. It must however be noted under such circumstances that the spring means utilized can have differing characteristics along the force path thereof, which means, that also springs can be used which at first have a soft characteristic and during an increase of force such springs provide an increasingly hard characteristic. Under such circumstances with a high pressure in the chamber 17, at first the rocker 14 only is moved against the spring, which means that the end 19 is lifted and such lifting of the end 19 then is increasingly more difficult or made harder because of the increasing spring pressure so that the rocker 14 again can shift the pump piston 7 upwardly and moreover so long until an equilibrium or balance prevails between the force of the spring and the pressure of the pump piston upon the rocker 14.

There is quite apparent from FIGS. 1 and 2 that with the present invention the cam shaft 12 is not arranged in alignment with the pump piston 7. Consequently there is made possible that the cam of the cam shaft can lift the end 19 of the rocker when a pressure in the chamber 17 is too high; under such conditions, the force exerted by the spring 22 upon the rocker is smaller than the pressure exerted by the pressure in the pump chamber 17. The arrangement of the present invention however permits also a lifting of the pump piston by the rocker 14 without having the end 19 of the rocker lifted. Both however can be possible only under such circumstances when the cam shaft is not arranged directly in alignment under the pump piston.

It is, of course, to be understood that the present invention is, by no means, limited to the specific showing in the drawings but also encompasses any modifications within the scope of the appended claims.

What I claim is:

1. A fuel injection pump, especially for an internal combustion engine having a cam shaft, which includes in combination:

a pump housing having a pump chamber therewith, a cylinder arranged in said pump housing and provided with control passage means for controlling the supply of fuel to said cylinder, a pump piston axially displaceable in said cylinder and turnable for controlling the fuel quantity to be injected, said pump piston having its circumferential surface provided with an oblique control groove for cooperation with said control passage, a cam rotatable by the cam shaft, a roller engageable with the cam, said roller being unaligned with the pump piston and displaceable by said cam relative to the axis of said cam shaft, a two arm rocker having one arm pivotally connected to said pump piston and having said roller mounted thereon intermediate the ends thereof, spring means operatively connected to the other arm of said rocker, and a stop mounted on said housing, said spring means continuously urging the other arm toward said stop whereby the pump piston continues to rise as the cam on the cam shaft rises so long as the pressure in the pump chamber is less than the pressure exerted by said spring means and whereby the pump piston does not rise when the pressure in the pump chamber exceeds the pressure exerted by the spring in which case the rocker rotates about the cam compressing the spring means.

2. A fuel injection pump in combination according to claim 1, in which the point of attack of said spring means upon said rocker is located between said stop and said roller.

3. A fuel injection pump in combination according to claim 1, in which said stop is formed by an angle lever rotatable about the pivot axis of said angle lever and rotatably journalled in said housing.

4. A fuel injection pump in combination according to claim 1, in which said spring means includes a fluid operable spring.

5. A fuel injection pump in combination according to claim 1, in which said spring means includes a mechanical spring and a fluid operable spring.

6. A fuel injection pump in combination according to claim 1, in which said spring means has a variable characteristic.

7. A fuel injection pump in combination according to claim 1, in which said spring means is under a pre-load approximately corresponding to the maximum admissible injection pressure.

8. A fuel injection pump in combination according to claim 1, in which said spring means is variable as to its characteristic in conformity with parameters of operation of the engine to be supplied with fuel by said fuel injection pump.

9. A fuel injection pump in combination according to claim 1, in which said spring means and said pump piston respectively act upon said rocker with lever arms of different length.

10. A fuel injection pump in combination according to claim 1, in which said stop is connected to said housing so as to permit a pivotal movement of said other arm while supporting the latter.

11. A fuel injection pump in combination according to claim 10, in which said stop is adjustably connected to said housing.

12. A fuel injection pump in combination according to claim 1, which includes an auxiliary piston interposed between said spring means and said other arm of said rocker, said auxiliary piston being continuously urged by said spring means in the direction toward said other rocker arm and establishing the operative connection between said spring means and said rocker.

13. A fuel injection pump in combination according to claim 12, in which said spring means includes a fluid operable spring, and in which conduit means are provided for establishing fluid communcation between said fluid operable spring and said auxiliary piston, and a one-way variable throttle interposed in said conduit means.

* * * * *